US005507683A

United States Patent [19]

Holm et al.

[11] Patent Number: 5,507,683

[45] Date of Patent: Apr. 16, 1996

[54] PARTICLE BLASTING MACHINE

[75] Inventors: John M. Holm, East Peoria; Robert K. Paternoga, Elmwood; Aaron D. Bean, Groveland, all of Ill.

[73] Assignee: Caterpillar Inc., Peoria, Ill.

[21] Appl. No.: 330,398

[22] Filed: Oct. 27, 1994

[51] Int. Cl.[6] ..... B24C 3/00

[52] U.S. Cl. ..... 451/2; 451/38; 451/75; 451/81; 451/3; 451/83

[58] Field of Search ..... 451/2, 3, 38, 75, 451/80, 81, 82, 83, 84

[56] References Cited

U.S. PATENT DOCUMENTS 4,037,364 7/1977 Freeman et al. ..... 451/2

4,614,064 9/1986 Bailey et al. ..... 451/83

*Primary Examiner*—Bruce M. Kisliuk
*Assistant Examiner*—Eileen P. Morgan
*Attorney, Agent, or Firm*—Kenneth A. Rhoads

[57] ABSTRACT

A particle blasting machine for deburring articles includes first, second, and third conveyors, first and second positioning elements, particle abrading apparatus and first and second ejecting elements. Articles are automatically ejected from the second conveyor onto the first conveyor and move in contact with the first positioning element. The second positioning element then moves into contact with the article initiating operation of the particle abrading element. The deburred article is then ejected by the second ejecting element onto the third conveyor.

7 Claims, 2 Drawing Sheets

PARTICLE BLASTING MACHINE

TECHNICAL FIELD

This invention relates generally to particle blasting machines for deburring or cleaning articles.

BACKGROUND ART

Conventionally, in so utilizing heretofore particle blasting machines, a human operator was required to feed the article into the machine, hold the article in a position so that continual contact with the particle abrading apparatus was maintained and manipulate the particle smoothing apparatus. Developing a machine of the construction of this invention eliminates the need for a human operator thereby avoiding waste of labor, human error, fatigue, time, and natural resources.

DISCLOSURE OF THE INVENTION

A particle blasting machine for deburring an article has first and second conveyors, first and second positioning elements, particle abrading apparatus, first and second ejecting elements and a controlling apparatus.

The second ejecting element is positioned adjacent the first conveyor and is adapted to intermittently, controllably move an article from the second conveyor onto the first conveyor.

The first positioning element is adjacent the second end portion of the first conveyor. The second positioning element is positioned on the first conveyor at a pre-selected location spaced from the first positioning element and is directed toward the first positioning element. The second positioning element is movable between a first position at which the second positioning element is spaced from the pathway of an article moving on the first conveyor toward the first positioning element and a second position at which the second positioning element is located in the pathway and is in contact with an article positioned between the first positioning element and the second positioning element. The particle abrading element is associated with one of the first and second positioning elements and adapted to forcibly deliver abrading particles against an article.

The second ejecting element is positioned at the middle portion of the first conveyor and is adapted to intermittently, controllably move an article from the first conveyor onto the third conveyor.

The controlling apparatus is connected to the ejecting elements, positioning elements, and the particle abrading apparatus. The controlling apparatus is adapted to actuate the first ejecting element in response to actuation of the second ejecting element. The controlling apparatus actuates the second positioning element to move from the first position to the second position in response to the initial contact of an article with the first positioning element and commences operation of the particle abrading apparatus in response to contact of an article with the particle abrading apparatus. Operation of the particle abrading apparatus is terminated in response to passage of a pre-selected period of time. The particle abrading apparatus is actuated by the controlling apparatus for movement from the second to the first position in response to terminating operation of the particle abrading apparatus. The second ejecting element is actuated in response to movement of the particle abrading apparatus toward the first position.

BEST MODE FOR CARRYING OUT THE INVENTION

Figure 1:
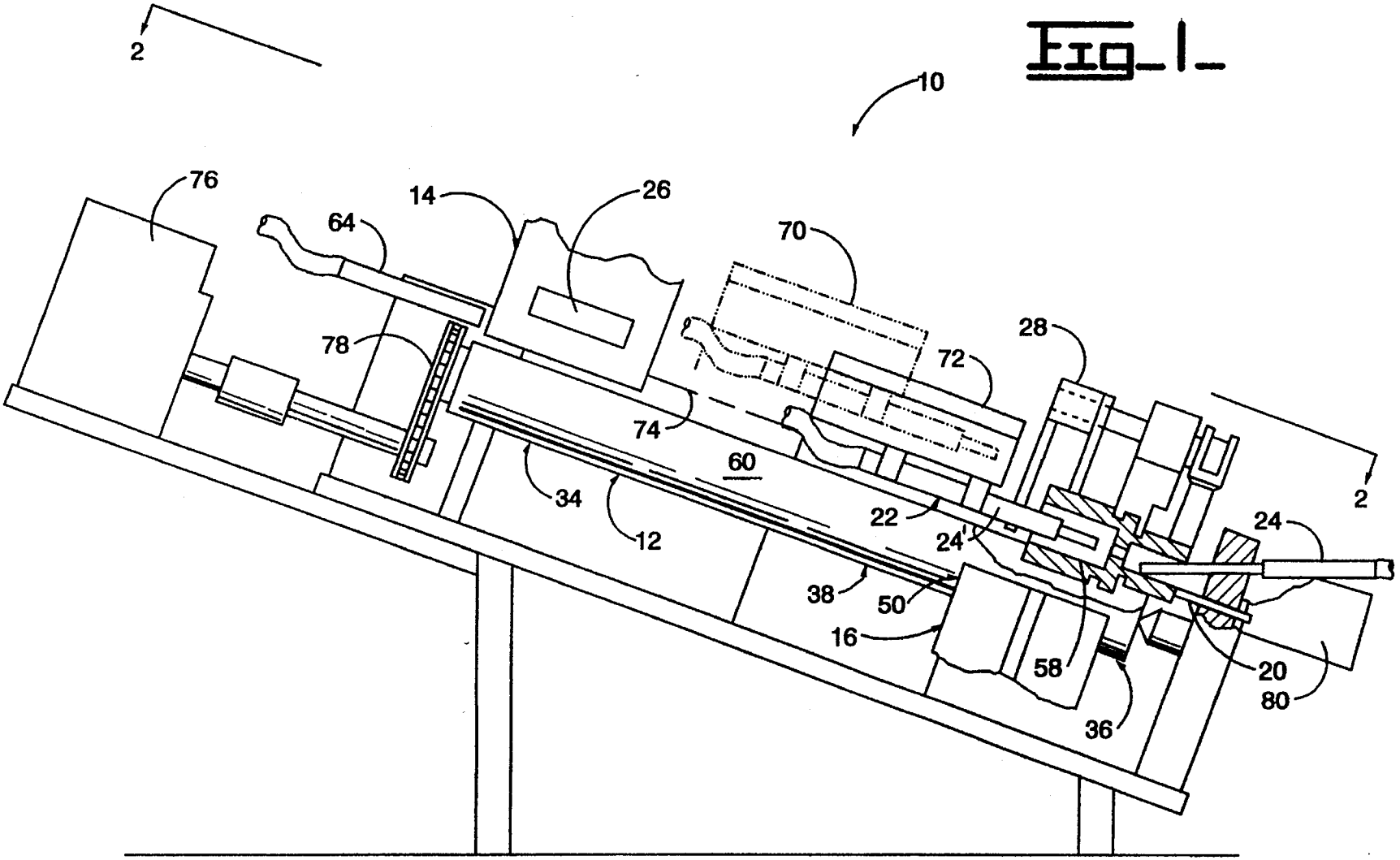
FIG. 1 is a diagrammatic side elevational, top view of the apparatus of this invention.
Figure 2:
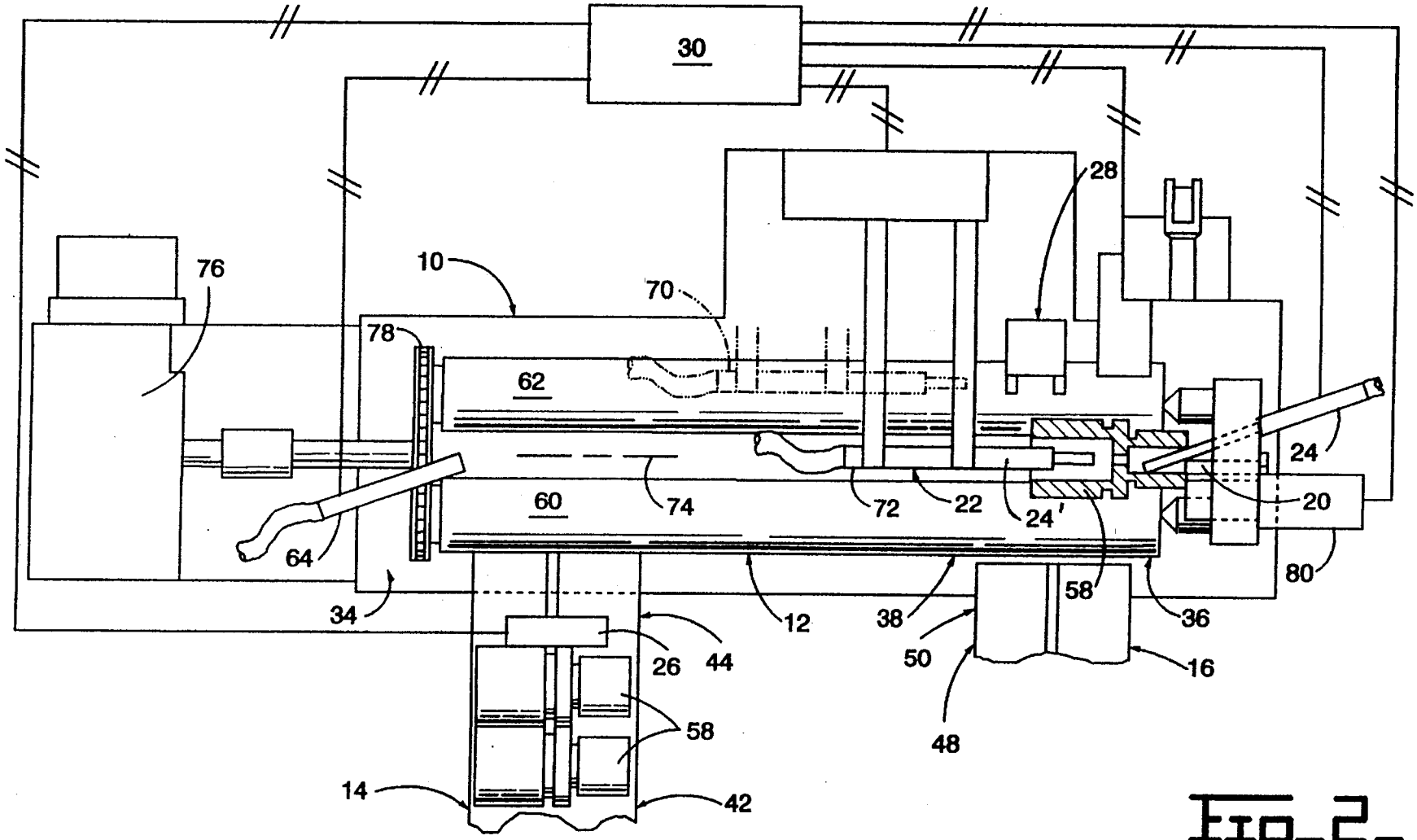
FIG. 2 is a diagrammatic top view of the apparatus of this invention taken in the direction of arrows 2—2 in FIG. 1.

Referring to FIGS. 1 and 2, the particle blasting machine 10 includes first, second and third conveyors 12, 14, 16, first and second positioning elements 20, 22, a particle abrading element 24 and first and second ejecting elements 26, 28 and a controlling apparatus 30. The first conveyor 12 has a longitudinal axis, first and second end portions 34, 36 and a middle portion 38. The second conveyor 14, having a longitudinal axis and first and second end portions 42, 44 and is positioned in close proximity to the first end portion 34 of the first conveyor 12. The third conveyor 16 has a longitudinal axis and first and second end portions 48, 50 and is positioned in close proximity to the middle portion 38 of the first conveyor 12. The first ejecting element 26 is positioned in close proximity to the second end portion 44 of the second conveyor 14 and is adapted to intermittently controllably move an article 58 from the second conveyor 14 to the first conveyor 12.

In a preferred embodiment, the first conveyor 12 has first and second spaced apart rollers 60, 62 extending along the longitudinal axis of the first conveyor 12. These rollers 60, 62 are adapted to assist in moving an article 58, to be deburred, down the first conveyor 12 by rotating the article 58 and thereby reducing the friction for gravity feed by the first conveyor 12 along the longitudinal axis.

An air pusher 64 is preferably utilized to force a stream of air in the direction toward and against the article 58 to assist in moving the article down the first conveyor 12. The first end portions 34, 42 of the first and second conveyors 12, 14, are positioned at a pre-selected locations higher in elevation than the second end portions 36, 44 of the respective first and second conveyors 12, 14. Therefore, an article 58 is gravity fed down the first conveyor 12 and into contact with the first positioning element 20. The first end portion 48 of the third conveyor 16 is positioned at a pre-selected location lower in elevation than the second end portion 50 of the third conveyor 16. The second ejecting element 28 is positioned at the middle portion 38 of the first conveyor 12 at a location adjacent the second end portion 50 of the third conveyor 16. The second ejecting element 28 is adapted to intermittently, controllably move an article 58 from the first conveyor 12 to the third conveyor 16. When the article 58 is ejected onto the third conveyor 16, the article 58 is gravity fed down the third conveyor 16 toward the first end portion 48 of the third conveyor 16.

The first positioning element 20 of the particle blasting machine 10 is located at the second end portion 36 of the first conveyor 12. The second positioning element 22 is moveable and is located at the middle portion 38 of the first conveyor 12 and spaced from the first positioning element 20. The particle abrading element 24' is connected to one of the first and second positioning elements 20, 22 and directed toward the other positioning element and generally along the longitudinal axis of the first conveyor 12. The second positioning element 22 is movable between first position and second positions 70, 72. At the first position 70 shown by broken lines in FIGS. 1 and 2, the second positioning element 22 is directed toward the first positioning element 20 and is spaced from a pathway 74 of an article 58 moving on the first conveyor 12. At the second position 72 shown by the solid lines in FIGS. 1 and 2, the second positioning element 22 is located in the pathway 74 and in contact with an article 58 positioned between the first and second positioning elements 20, 24.

The controlling apparatus 30 is connected to the first and second ejecting elements 26, 28, the first and second positioning elements 20, 22 and the particle abrading element 24. The controlling apparatus 30 is adapted to actuate the air pusher 64 and the first ejecting element 54 causing the ejecting element to contact the article 58 and pass the article onto the first conveyor 12 at pre-selected intervals in response to actuation of the second ejecting element 68. The controlling apparatus 30 actuates the second positioning element 22 and moves the second positioning element from the first position 70 to the second position 72 in response to initial contact of an article 58 with the first positioning element 20. The controlling apparatus 30 actuates the particle abrading element 24, for deburring of the article 58, in response to the second positioning element 22, being at the second position 72. The actuated particle abrading element 24 automatically impacts the article 58 with abrading particles for a preselected period of time after which operation of the particle abrading element 24 is terminated. The controlling apparatus 30, after passage of the time period, then actuates the second positioning element 22 and moves the second positioning element 22 from the second position 72 to the first position 70. Arrival of the second positioning element 22 at the first position 70 actuates the second ejecting element 68 and causes the second ejecting element 68 to come into contact with the article 58 and eject the article 58 from the first conveyor 12 and initiate passage of another article 58 from the second conveyor 14 onto the first conveyor 12.

As is well known in the art, the power source for the rollers 60, 62 can be an electric motor 76 with a chain 78 interconnect and the particle abrading element 24 is preferably a Micro Blaster, Model No. MB1000-1 manufactured by Comco Inc. whose address is 2151 N. Lincoln St. Burbank, Calif. 91504.

Movement of the second positioning element 22 can be either electrical or hydraulically actuated as can be the ejecting elements 44, 68. The article 58 in the example illustrated, has a concave or counterbore end portion, and axial movement of the article 58 is necessary prior to ejecting the article 58 from the first conveyor 12. When the article 58 geometry so dictates, an actuator 80 is associated with the second positioning element 36. The actuator 80 extends and retracts along the pathway 74 of the article 58 to controllably space the article 58 from the first positioning element 20 prior to actuating the second ejecting element 68. In such construction, the third conveyor 16 and second ejecting element 68 are positioned further toward the first end portion or opposed end of the first conveyor 12.

INDUSTRIAL APPLICABILITY

In using the particle blasting machine an operator loads the second conveyor 14 with articles 58. These articles 58 are automatically ejected from the second conveyor 14 onto the first conveyor 12 and move into contact with the first positioning element 20. The second positioning element 22 then moves into contact with the article 58 initiating operation of the particle abrading element 24. The particle abrading element 24 automatically impacts the article 58 with abrading particles deburring the article. The deburred article 58 is then ejected by the second ejecting element 28 onto the third conveyor 16.

We claim:

1. A particle blasting machine for deburring an article, comprising:

first and second adjacent conveyors each having a longitudinal axis, first and second end portions, a middle portion and being adapted for respectfully moving articles therealong;

a first ejecting element positioned adjacent the first conveyor and being adapted to intermittently, controllably move an article from the second (first) conveyor onto the first conveyor;

a first positioning element positioned adjacent the second end portion of the first conveyor;

a second positioning element positioned on the first conveyor at a preselected location spaced from the first positioning element and directed toward the first positioning (apparatus) element, said second positioning element being movable between a first position spaced from a (the) pathway of an article moving on the first conveyor in a direction toward the first positioning element and a second position at which the second positioning element is located in said pathway and in contact with an article positioned between the first and second positioning elements;

a particle abrading element associated with one of the first and second positioning elements and being adapted to forcibly deliver abrading particles against an article;

a (an) second ejecting element positioned at the middle portion of the first conveyor and being adapted to intermittently, controllably remove (move) an article from the first conveyor; and a controller (controlling apparatus) connected to the (article source), ejecting elements, positioning elements and particle abrading apparatus, and being adapted to (actuate the article source in response to actuation of the second ejecting element,) actuate the second positioning element to move from first to the second position in response to initial contact of an article with the first positioning element and initiate operation of the particle abrading apparatus in response to contact of the article with the first positioning element, terminating operation of the particle abrading apparatus in response to passage of a pre-selected period of time, actuating the second positioning element apparatus for movement from the second to the first position in response to terminating operation of the particle abrading apparatus and actuating the second ejecting element in response to movement of the second positioning element toward the first position.

2. A particle blasting machine, as set forth in claim 1, wherein a first end portion of the first conveyor is positioned at a preselected location higher in elevation than a second end position of the first conveyor.

3. A particle blasting machine, as set forth in claim 1, wherein the first conveyor include first and second rollers extending along the longitudinal axis of the first conveyor; said rollers being adapted to controllably rotate an article during movement of the article down the first conveyor.

4. A particle blasting machine as set forth in claim 1, which includes an air pusher adapted to controllably impact an article with an air stream and move the article down the first conveyor.

5. A particle blasting machine, as set forth in claim 1, wherein the particle abrading element is connected to the first positioning element.

6. A particle blasting machine, as set forth in claim 1, wherein a particle abrading element is connected to each positioning element.

7. A process for deburring an article by controllably impacting the article with abrading particles, comprising;

passing an article onto a first conveyor at preselected intervals in response to actuation of a first ejecting element;

passing the article into contact with a first positioning element and responsively actuating a second positioning element to move from a (the) first position spaced from the article to a second position in contact with the article;

automatically impacting the article with abrading particles in response to contact of the article with the first positioning element;

terminating impacting of the article in response to passage of a pre-selected interval of time;

actuating the second positioning element for movement from the second to the first position in response to (the) passage of said pre-selected interval of time (period);

ejecting the article from the first conveyor in response to the second positioning element being at the first position; and (actuation of second positioning element for movement from the second to the first position; and)

initiating passage of another article onto the first conveyor in response to ejecting the (deburred) impacted article from the first conveyor.

* * * * *

UNITED STATES PATENT AND TRADEMARK OFFICE

CERTIFICATE OF CORRECTION

PATENT NO. : 5,507,683

DATED : April 16, 1996

INVENTOR(S) : John M. Holm et al.

It is certified that error appears in the above-identified patent and that said Letters Patent is hereby corrected as shown below:

Column 4, claim 1, line 13, delete "(first)";
line 20, delete "(apparatus)";
line 22, delete "(the)";
line 31, delete "(an)";
line 35, delete "(controlling apparatus)";
line 36, delete "(article source)";
line 37, delete "(actuate the article source in response to actuation of the second ejecting element,)";

Column 5, claim 7, line 12, delete "(the)".

Column 6, claim 7, line 4, delete "(the)";
line 5, delete "(period)";
line 10, delete "(actuation of second positioning element for movement from the second to the first position; and)";
line 13, delete "(deburred)".

Signed and Sealed this

Third Day of September, 1996

*Attest:*

*Attesting Officer*

Bruce Lehman

BRUCE LEHMAN

*Commissioner of Patents and Trademarks*